US007393474B2

(12) United States Patent
Park et al.

(10) Patent No.: US 7,393,474 B2
(45) Date of Patent: Jul. 1, 2008

(54) CONDUCTIVE COATING COMPOSITION FOR PROTECTIVE FILM AND METHOD FOR PRODUCING COATING LAYER USING THE SAME

(75) Inventors: Jong-Dai Park, Kyungki-Do (KR); Jong-Chul Shin, Kyungki-Do (KR); Ho-Kyu Lee, Kyungki-Do (KR)

(73) Assignee: Dongjin Semichem Co., Ltd., Incheon (KR)

( * ) Notice: Subject to any disclaimer, the term of this patent is extended or adjusted under 35 U.S.C. 154(b) by 0 days.

(21) Appl. No.: 11/715,349

(22) Filed: Mar. 8, 2007

(65) Prior Publication Data

US 2007/0257235 A1 Nov. 8, 2007

(30) Foreign Application Priority Data

Mar. 16, 2006 (KR) ..... 10-2006-0024370

(51) Int. Cl.
*H01B 1/00* (2006.01)

(52) U.S. Cl. ..... 252/500; 528/377; 524/104

(58) Field of Classification Search ..... 252/500, 252/535; 525/535, 547, 103; 528/377
See application file for complete search history.

(56) References Cited

U.S. PATENT DOCUMENTS 5,766,515 A * 6/1998 Jonas et al. ..... 252/500
6,084,040 A * 7/2000 Jonas et al. ..... 525/535
6,852,250 B2 * 2/2005 Haghighat et al. ..... 252/500
2003/0006401 A1 * 1/2003 Haghighat et al. ..... 252/500
2003/0035917 A1 * 2/2003 Hyman ..... 428/67
2004/0258952 A1 * 12/2004 Haghighat et al. ..... 428/690

FOREIGN PATENT DOCUMENTS

JP 2005-281704 A 10/2005
KR 2002-0016549 A 3/2002
KR 10-2006-098582 * 9/2006

OTHER PUBLICATIONS

Machine translation of 10-2006-0098582.*

* cited by examiner

*Primary Examiner*—Mark Eashoo
*Assistant Examiner*—Asdjodi M. Reza
(74) *Attorney, Agent, or Firm*—Birch, Stewart, Kolasch & Birch, LLP

(57) ABSTRACT

A conductive coating composition and a method for producing coating layer using the same are disclosed. The conductive coating composition is capable of forming an antistatic coating layer on the protective film surface of display device. The conductive coating composition includes: 1 to 30 wt % of polyethylene dioxythiophene aqueous-dispersed solution; 5 to 15 wt % of water-soluble binder resin; 0.2 to 10 wt % of melamine resin; 6 to 40 wt % of alcohol solvent; 5 to 30 wt % of organic solvent selected from the group consisting of dimethyl sulfoxide, propyleneglycol methylether, N-methylpyrrolidone, ethyl-3-ethoxypropionate, propyleneglycol monomethyletheracetate, butylcarbitol and the mixtures thereof; and 10 to 50 wt % of water. The method for producing the conductive coating layer includes the steps of coating the conductive coating composition on a substrate; and drying the coating composition.

6 Claims, No Drawings

CONDUCTIVE COATING COMPOSITION FOR PROTECTIVE FILM AND METHOD FOR PRODUCING COATING LAYER USING THE SAME

FIELD OF THE INVENTION

This invention relates to a conductive coating composition for protective film and method for producing coating layer using the same, and more particularly, to a conductive coating composition for protective film, which has a superior antistatic function and a little aging change of the antistatic function, and an enhanced coating property to the plastic substrate such as polyethylene terephthalate(PET) and is useful for forming an antistatic coating layer particularly on LCD polarizer protective film, and method for producing coating layer using the composition.

BACKGROUNDS OF THE INVENTION

Conductive polymer is widely being used for antistatic and electromagnetic wave-shielding coating layer, fuel cell, transparent electrode and so on. Particularly in the field of antistatic coating layer on the exterior glass of display device like CRT, LCD, PDP, transport tray for semiconductor device, LDC polarizer protective film, backlight unit protective film and so on, the conductive polymer becomes commercially used rapidly. Recently, as flat display devices are magnified, conductive coating layer, which can prevent goods from being damaged by static electricity as well as prevent from scratch and dust, becomes important. For example, the static electricity occurs because of a film adhesion in the step of removing protective film during the production of large LCD substrate, which may result in a fatal damage.

As conductive components of the antistatic coating layer, metal(aluminum, etc.), carbon black, non-conductive polymer containing conductive additives (surfactant which has ion conductivity when it reacts with moisture) and conductive polymer(polythiophene, polypyrrole, polyaniline, which themselves have conductivity) are known. As the surfactant, a quaternary ammonium divalent salt type surfactant was used, but it had a limit for LCD protective film of high quality TFT because of the low antistatic function. Also, the conventional conductive polymer is not easy to be mass-produced, and has disadvantages of low solubility, light permeability, thermal stability and external stability. Polyethylene dioxythiophene (PEDT), a conductive polymer which overcame the above mentioned disadvantages to improve processing property, light permeability and moisture-resistance, was developed by Bayer (U.S. Pat. No. 5,035,926). In addition, Baytron P and Baytron P H, which are PEDT doped with polystyrene sulfonic acid(a polymer acid), are placed on the market. However, PEDT(Baytron P, Baytron PHI, etc.) itself is an aqueous-dispersed solution, consequently, has a limit for coating property such as adhesion to the substrate(polymer film, glass etc.), strength of layer and drying property.

Generally, the conductive coating layer is formed by coating a coating composition which includes conductive polymer, water-soluble or alkali-soluble binder and volatile solvent(alcohol, etc.) on a substrate(thing to be coated, glass, polymer film, etc.); and drying at a certain temperature. As an example of the coating composition, an antistatic coating composition was disclosed, which included Baytron P as the conductive polymer and self-emulsifying polyester resin aqueous-dispersed solution (Korean Patent Publication No. 2002-0016549, Japanese Patent Publication No. 2005-281704). The surface resistance of coating layer formed with the coating composition was initially $10^{5\sim6}$ Ω/□, and it increased sharply after 10 days to $10^{12}$Ω/□, consequently, the antistatic function becomes inferior as time passes. This aging property is so inferior that the initial low surfaces resistance is meaningless, and there is a problem with applying it to high quality and large LCD.

SUMMARY OF THE INVENTION

Therefore, it is an object of the present invention to provide a conductive coating composition which has a superior antistatic function and improved aging property of the antistatic function, and a method for producing coating layer using the same.

It is; other object of the present invention to provide a conductive coating composition which has an enhanced adhesion to plastic substrate and strength of layer, and a method for producing coating layer using the same.

To accomplish these objects, the present invention provides a conductive coating composition comprising: 1 to 30 wt % of polyethylene dioxythiophene aqueous-dispersed solution; 5 to 15 wt % of water-soluble binder resin; 0.2 to 10 wt % of melamine resin; 6 to 40 wt % of alcohol solvent; 5 to 30 wt % of organic solvent selected from the group consisting of dimethyl sulfoxide, propyleneglycol methylether, N-methylpyrrolidone, ethyl-3-ethoxypropionate, propyleneglycol monomethyletheracetate, butylcarbitol and the mixtures thereof; and 10 to 50 wt % of water. The present invention also provides a method for producing the conductive coating layer comprising the steps of: coating the conductive coating composition on a substrate; and drying the coating composition.

DETAILED DESCRIPTION OF THE INVENTION

A more complete appreciation of the invention, and many of the attendant advantages thereof, will be better appreciated by reference to the following detailed description.

The polyethylene dioxythiophene aqueous-dispersed solution is formed by dispersing polyethylene dioxythiophene (PEDT) in water. The aqueous-dispersed solution, if desired, can further include a little amount of conductive doping agent such as polystyrenesulfonic acid(PSS). As a product placed on the market, Baytron P or Baytron PH manufactured by Bayer can be used. The amount of PEDT is 1.4 wt % with respect to the aqueous-dispersed solution. The amount of PEDT aqueous-dispersed solution is preferably 1 to 30 wt % with respect to the total coating composition. Within maintaining regular amount of PEDT in the coating composition, the concentration of the PEDT aqueous-dispersed solution, if desired, can be differed freely. For example, in case of increasing the amount of PEDT in the aqueous-dispersed solution to 2.8 wt %, the amount of PEDT can be kept regularly by reducing the amount of the PEDT aqueous-dispersed solution to be introduced into the total coating composition by ½ times amount. When the amount of the PEDT aqueous-dispersed solution is less than 1 wt %, the surface resistance of the coating layer increases, which might cause deteriorate antistatic and electromagnetic wave-shielding property. On the contrary, when the amount of the PEDT aqueous-dispersed solution is more than 30 wt %, it is economically undesirable and the coating property of the coating composition is deteriorated without any particular improvement of antistatic property.

The water-soluble binder resin according to the present invention increases dispersibility of the conductive polymer, and enhances layer-uniformity, adhesion, strength of layer and so on. The binder resin includes the conventional photocuring or thermosetting binders widely. The photocuring or thermosetting binder includes polyurethane, polymethylmethacrylate, polyacrylate, polyvinylalcohol, polyvinylacetal, polyvinylacetate and the mixtures thereof, and so on. Preferably, the water-soluble thermosetting polyurethane resin can be used, because it enhances adhesion and strength of a formed coating layer. The amount of the water-soluble binder resin is preferably 5 to 15 wt % with respect to the total coating composition. When the amount of the water-soluble binder resin is less than 5 wt %, the uniformity, adhesion and strength of the coating layer decrease, but when the amount of the water-soluble binder resin is more than 15 wt %, the dispersibility of the conductive polymer is reduced and the number of stain increases when coating a large area, which is undesirable.

The melamine resin according to the present invention is used for improving aging property of the antistatic function of the coating layer, and it maintains an initial antistatic function even though time passes after coating. The amount of the melamine resin is preferably 0.2 to 10 wt % with respect to the total coating composition. When the amount of the melamine resin is less than 0.2 wt %, the aging property of the coating layer cannot be improved sufficiently, but when the amount of the melamine resin is more than 10 wt %, the surface resistance of coating layer increases and the number of stain increases when coating, which is undesirable.

The conductive coating composition according to the present invention includes 6 to 40 wt %, preferably 10 to 30 wt % of alcohol solvent. The alcohol solvent has a function of improving the coating property such as drying property of the coating composition. As the alcohol solvent, alcohol compounds, which are conventionally used in polymer coating composition, can be used widely. Preferably, lower alcohol having 1 to 5 of carbon atoms; more preferably, isopropyl alcohol(IPA), ethanol or the mixture thereof; most preferably, a mixture of 5 to 20 wt % of ethanol and 1 to 20 wt % of isopropyl alcohol can be used. When the amount of the alcohol solvent is less than 6 wt % with respect to the total coating composition, the drying property is liable to be deteriorated, but when the amount of the alcohol solvent is more than 40 wt %, the dispersibility of the conductive polymer is reduced, which may result in the increase of surface resistance.

The conductive coating composition according to the present invention further includes functional organic solvent with the alcohol solvent to improve the coating property like solubility, dispersibility, drying property, layer-uniformity and so on. The organic solvent includes dimethyl sulfoxide (DMSO), propyleneglycol methylether(PGME), N-methylpyrrolidone(NMP), ethyl-3-ethoxypropionate(EEP), propyleneglycol monomethyletheracetate(PGMEA), butylcarbitol(BC) and the mixtures thereof and so on. Preferably, dimethyl sulfoxide can be used. The amount of the organic solvent is 5 to 30 wt %, preferably 10 to 30 wt % with respect to the total coating composition. When the amount of the organic solvent is less than 5 wt %, the coating property of the coating composition decreases and a non-uniform layer can be produced, but when the amount of the organic solvent is more than 30 wt %, the drying property can be deteriorated without any improvement of the coating property.

The remaining component of the conductive coating composition according to the present invention is water, and preferably deionized water (D.I.W). The amount of water is preferably 10 to 50 wt %. When the amount of water is less than 10 wt %, the concentration of the coating composition is too high that the coating property is liable to be deteriorated, but when the amount of water is more than 50 wt %, it is economically undesirable and there is no great improvement.

The coating composition according to the present invention can be produced by mixing the components, if desired, with stirring. And preferably, the composition can be produced by mixing alcohol solvent, organic solvent and water with stirring and then introducing, respectively in order, water-soluble binder resin, melamine resin and polyethylene dioxythiophene aqueous solution into the mixed solvent with stirring, and doing the introduction repeatedly. Subsequently, the produced (composition is coated on the substrate(glass, polymer film etc.) with bar-coating, spraying, spin-coating and so on, and then the conductive coating layer can be formed by drying at a certain temperature, for example, about 80° C. The preferable substrate(thing to be coated) includes polymethylmethacrylate resin film, polyacryl resin film, polycarbonate resin film, polyethylene terephthalate resin film, PVC resin film and so on. The formed layer is useful for the antistatic coating layer on the exterior glass of display device like CRT, LCD, PDP and so on, LCD polarizer protective film or backlight unit protective film, transport tray for semiconductor device, coating layer of packing sheet, and so on, and particularly, most useful for PET substrate of LCD polarizer protective film.

Hereinafter, the preferable examples are provided for better understanding of the present invention. However, the present invention is not limited to the following examples. In the following examples, the percentage and mixture ratio were by weight.

EXAMPLE 1

Preparing Conductive Polymer Coating Layer

According to the components and amount as shown in Table 1, alcohol solvent, organic solvent and water was mixed and stirred, and then, water-soluble polyurethane resin was introduced into the mixed solvent and stirred. Subsequently, melamine resin was introduced into the mixture and stirred, and then, polyethylene dioxythiophene aqueous-dispersed solution was introduced and stirred to produce a coating composition. The used polyethylene dioxythiophene aqueous solution was "Baytron P"(1.4 wt % of PEDT) manufactured by Bayer, which is doped with polystyrenesulfonate. In Table 1, IPA stands for isopropyl alcohol, DMSO stands for dimethylsulfoxide, MEK stands for methylethylketone, and D.I.W stands for deionized water.

TABLE 1

| | PEDT | Alcohol | | Solvent | | | Resin | |
|---|---|---|---|---|---|---|---|---|
| | Baytron P | Ethanol | IPA | DMSO | MEK | D.I.W | Polyurethane | Melamine |
| Example 1 | 20 | 10 | 15 | 20 | | 10 | 15 | 10 |
| Comparative Example 1 | 15 | 15 | 15 | 20 | | 20 | 15 | — |

TABLE 1-continued

| | PEDT | Alcohol | | Solvent | | | Resin | |
|---|---|---|---|---|---|---|---|---|
| | Baytron P | Ethanol | IPA | DMSO | MEK | D.I.W | Polyurethane | Melamine |
| Comparative Example 2 | 15 | 5 | 10 | — | 20 | 35 | 15 | — |
| Comparative Example 3 | 15 | — | — | 25 | | 55 | 5 | — |
| Comparative Example 4 | 20 | 19.9 | 10 | 25 | | 10 | 15 | 0.1 |

The prepared coating composition was coated on polyethylene terephthalate(PET) resin film with bar coater, and dried on a hot plate of 80° C. for 1 minute. Right after drying, the property(surface resistance, layer-uniformity) of the formed coating layer was measured. After 10 days, the surface resistance was measured again and shown in Table 2. In Table 2, the surface resistance of coating layer was measured with "ST-3" equipment manufactured by SIMCO, and the uniformity of coating layer was observed with the naked eye and estimated.

TABLE 2

| | surface resistance | | properties of layer | |
|---|---|---|---|---|
| | right after coating | 10 days after coating | aging property | layer-uniformity |
| Example 1 | $1 \times 10^6$ (Ω/□) | $1.6 \times 10^6$ (Ω/□) | good | good |
| Comparative Example 1 | $2 \times 10^6$ (Ω/□) | $5 \times 10^{12}$ (Ω/□) | inferior | good |
| Comparative Example 2 | $1 \times 10^9$ (Ω/□) | $2 \times 10^{12}$ (Ω/□) | inferior | good |
| Comparative Example 3 | $1 \times 10^6$ (Ω/□) | $2.5 \times 10^6$ (Ω/□) | good | inferior |
| Comparative Example 4 | $1.3 \times 10^6$ (Ω/□) | $6.3 \times 10^9$ (Ω/□) | inferior | good |

As shown in Table 2, the coating layer prepared in Comparative Example 1 showed a good coating property(layer-uniformity), and the initial surface resistance was low and the antistatic function was good, however, after 10 days, the surface resistance increased drastically and the aging property of the surface resistance was inferior. Example 1, having melamine resin unlike Comparative Example 1, showed a low initial surface resistance, and also a superior aging property of antistatic function because the increased value of the surface resistance after 10 days was very small. Comparative Example 2 showed a good coating property, but a high initial surface resistance and an inferior aging property. Comparative Example 3 does not have melamine resin, but showed a good antistatic function and a good aging property by controlling the amount of the other components. However, it had an inferior coating property and some stains occurred on the layer. Comparative Example 4 was not effective for improving aging property because the amount of melamine resin was not enough.

As described above, the conductive coating composition for protective film and the substrate coated with the coating composition have not only a superior antistatic function, but also an improved aging property, which is capable of maintaining an initial antistatic function even though time passes due to the use of the melamine resin, and are environmental familiar due to the use of water-soluble solvent, and have a coating property and transparency suitable for the protective film of display. While the present invention has been described in detail with reference to the preferred embodiments, those skilled in the art will appreciate that various modifications and substitutions can be made thereto without departing from the spirit and scope of the present invention as set for in the appended claims.

The invention claimed is:

1. A conductive coating composition comprising:

1 to 30 wt % of polyethylene dioxythiophene aqueous-dispersed solution;

5 to 16 wt % of water-soluble binder resin;

0.2 to 10 wt % of melamine resin;

6 to 40 wt % of alcohol solvent;

5 to 30 wt % of organic solvent selected from the group consisting of dimethyl sulfoxide, propyleneglycol methylether, N-methylpyrolidone, ethyl-3-ethoxypropionate, propyleneglycol monomethyletheracetate, butylcarbitol and the mixtures thereof; and 10 to 50 wt % of water.

2. The conductive coating composition according to claim 1, wherein the water-soluble binder resin is water-soluble thermosetting polyurethane resin.

3. The conductive coating composition according to claim 1, wherein the alcohol solvent is a mixture of 5 to 20 wt % of ethanol and 1 to 20 wt % of isopropyl alcohol.

4. The conductive coating composition according to claim 1, wherein the amount of polyethylene dioxythiophene is 1.4 wt % with respect to the polyethylene dioxythiophene aqueous-dispersed solution.

5. A method for producing the conductive coating layer comprising the steps of:

coating the conductive coating composition of claim 1 on a substrate; and drying the coating composition.

6. The method for producing the conductive layer according to claim 5, wherein the conductive coating composition is prepared by the steps of:

mixing water, alcohol solvent and organic solvent which is selected from the group consisting of dimethyl sulfoxide, propyleneglycol methylether, N-methypyrolidone, ethyl-3-ethoxypropionate, propyleneglycol monomethyetheracetate, butylcarbitol and the mixtures thereof:

mixing the mixed solvent and water-soluble binder resin;

mixing the mixture and melamine resin; and mixing the mixture and polyethylene dioxythiophene aqueous-dispersed solution.

* * * * *